United States Patent [19]

Vickers

[11] Patent Number: 4,490,884

[45] Date of Patent: Jan. 1, 1985

[54] ADJUSTABLE FRICTION HINGE

[75] Inventor: James H. Vickers, Middletown, Pa.

[73] Assignee: Southco, Inc., Concordville, Pa.

[21] Appl. No.: 509,361

[22] Filed: Jun. 30, 1983

[51] Int. Cl.[3] ..... E05D 11/08

[52] U.S. Cl. ..... 16/338; 16/342; 16/386; 16/DIG. 13

[58] Field of Search ..... 16/338, 342, 380, 385, 16/386, DIG. 13

[56] References Cited

U.S. PATENT DOCUMENTS

| | | | |
|---|---|---|---|
| 1,033,582 | 7/1912 | Harris | 16/338 |
| 1,175,560 | 3/1916 | Rixson | 16/338 |
| 1,922,365 | 8/1933 | Heasley | 16/338 |
| 2,602,957 | 7/1952 | Anderson | 16/338 |
| 2,929,093 | 3/1960 | Conlee | 16/338 |
| 3,593,364 | 7/1971 | Lia | 16/380 X |
| 3,703,742 | 11/1972 | Konishi | 16/385 |
| 4,175,315 | 11/1979 | Hayes, Sr. et al. | 16/380 X |

FOREIGN PATENT DOCUMENTS

| | | | |
|---|---|---|---|
| 165899 | 12/1884 | France | 16/386 |
| 356464 | 6/1938 | Italy | 16/386 |
| 41-11488 | 3/1966 | Japan | 16/386 |
| 374304 | 2/1964 | Switzerland | 16/380 |

*Primary Examiner*—Fred A. Silverberg
*Attorney, Agent, or Firm*—Paul & Paul

[57] ABSTRACT

An adjustable friction hinge assembly of thermoplastic material comprises a first hinge leaf having spaced apart non-adjustable knuckles having non-circular through holes, and a second hinge leaf having a single knuckle which fits into the space between the spaced-apart non-adjustable knuckles. The hinge pin has non-circular portions which are received with the corresponding non-circular through holes of said spaced-apart knuckles, and which prevent rotation of said hinge pin in said knuckles. The inside diameter of the middle knuckle is adjustable by an adjustment screw, thereby to control the frictional torque resistance of the knuckle on the hinge pin. Provision is made for squeezing some of the plastic material into the threads of said adjustment screw, thereby to maintain the adjustment at its initially set position despite repeated openings and closings of the hinged door, cover or lid.

3 Claims, 7 Drawing Figures

ADJUSTABLE FRICTION HINGE

BACKGROUND OF THE INVENTION

This invention relates to a hinge assembly for an access door or lid or cover or the like.

The invention relates in particular to a hinge assembly for an access door which, when opened, is intended to remain in the open position and should not swing shut.

The invention also relates particularly to a hinge assembly for a hinged lid or cover which when raised is intended to remain in the raised position and should not fall down.

The prior art has provided an adjustable door hinge in which the hinge pin is fixed, as by welding, to the door. The prior art hinge body comprises a single adjustable clamping knuckle made of flexible thermoplastic material which embraces the diameter of the hinge pin and has a flat portion extending therefrom. The torque friction on the hinge pin is adjustable by means of a screw which is screwed into the flat extended portion of the clamping knuckle. By tightening the screw, the clamping knuckle may be tightened about the hinge pin.

SUMMARY OF THE INVENTION

The principal object of the present invention is to provide an improved hinge assembly for access doors which should not swing shut when left in the opened position and for lids or covers which should not fall down when left in a raised position.

Another object of the present invention is to provide an adjustable friction hinge assembly having two leaves in which the free-swinging action which normally characterizes a two-leaf hinge is modified by providing controllable friction between the hinge pin and a single knuckle in one of the hinge leaves, with the hinge pin fixed against rotation in spaced-apart knuckles of the other hinge leaf.

Another object is to provide an adjustable friction hinge in which the rotational movement of hinge leaves relative to each other is controlled solely by the adjustment of one of three knuckles.

A more specific object is to provide an adjustable friction hinge in which the rotational movement about the hinge pin is controlled by a middle clamping knuckle on one of the hinge leaves, with the other hinge leaf fixed against rotation relative to the hinge pin.

Another object is to provide an adjustable friction hinge which, when adjusted, will retain that adjustment during repeated openings and closings of the access door, cover or lid.

These and other objects are accomplished by providing a hinge of thermoplastic material so designed and constructed that, upon tightening of an adjustment screw, the plastic material embracing the reduced-diameter central portion of the hinge pin is tightened thereby prevent free rotational movement of the door or lid or cover relative to the hinge pin.

For the purpose of preventing loss of adjustment after repeated openings and closings, plastic material is squeezed into the threads of the screw during tightening to provide a drag which will prevent rotation of the screw during use, thereby maintaining the adjustment at the selected position.

DETAILED DESCRIPTION OF THE PREFERRED EMBODIMENTS

Figure 1:
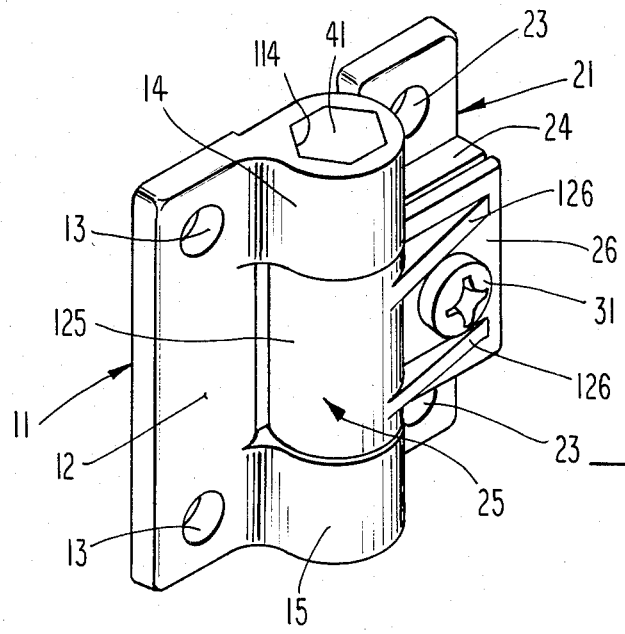
FIG. 1 is a perspective view of a hinge assembly according to the present invention.

Referring now to FIG. 1, there is shown a hinge assembly which incorporates the improvement of the present invention. In FIG. 1, the position of the hinge is shown to be vertical. While the hinge of the present invention can be used on doors which swing on vertical hinges, the widest use of the hinge is on doors, lids or covers which swing on horizontally disposed hinges and which when the door, lid or cover is raised to gain access to the interior, are intended to remain in the raised position without falling down.

Figure 2:
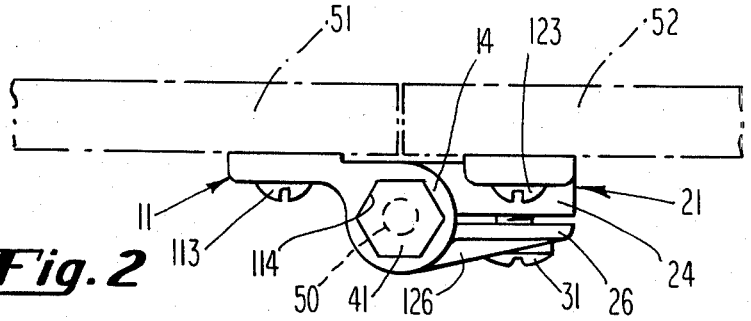
FIG. 2 is a side view of the hinge assembly of FIG. 1.

The hinge assembly comprises a non-adjustable hinge leaf 11 and an adjustable hinge leaf 21. One of these leaves is secured to the frame while the other is secured to the pivotally liftable door, cover or lid. In FIG. 2, the fixed hinge leaf 11 is assumed to be secured to the cover or lid 51 while the adjustable hinge leaf 21 is assumed to be secured to the frame 52. However, these positions can be reversed.

Figure 3:
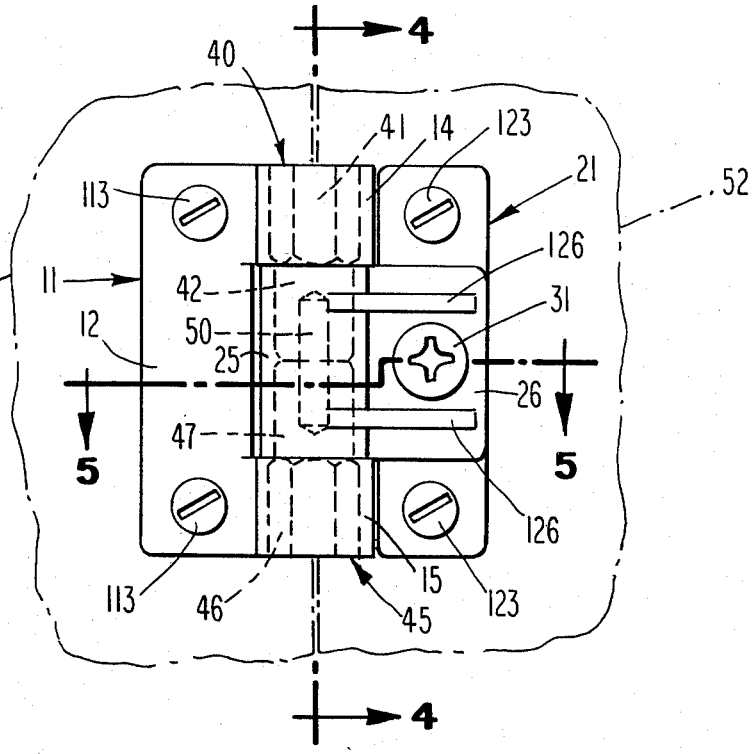
FIG. 3 is a plan view of the hinge assembly of FIGS. 1 and 2.

The hinge leaf 11 has a flat portion 12 which is provided with a pair of holes 13 for receiving the screws 113, not shown in FIG. 1 but seen in FIGS. 2 and 3. The hinge leaf 11 includes a pair of spaced apart knuckles 14 and 15, each of which has a center hole or bore 114,115 for receiving the hinge pin. In accordance with the present invention the hole or bore 114,115 in the non-adjustable knuckles 14,15, is non-circular in cross section for the purpose of receiving a correspondingly shaped non-circular portion of the hinge pin. In the illustrated embodiment, the non-circular hole or bore 114,115 is shown to be hexagonal for the purpose of receiving a hinge pin having hexagonal portions. It is to be understood, however, that the non-circular hole 114,115 in the knuckles 14,15, and the non-circular portion of the hinge pin, could be square, or rectangle, or octagonal, or other non-circular shape.

The hinge leaf 21 includes an adjustable knuckle 25 which functions as a clamp. The knuckle 25 is inserted into the space between the two non-adjustable knuckles 14,15 of the hinge leaf 11.

The wrap-around portion 125 of the clamping knuckle 25 has an extension 24 which is integral with the body of the hinge leaf 21. The wrap-around portion 125 also has an outer extension 26, the position of which relative to that of the extension 24 is adjustable by means of an adjustment screw 31. When the adjustment screw 31 is tightened, the wrap-around portion 125 is caused to embrace the hinge pin more tightly, thereby increasing the frictional torque resistance. A pair of ribs 126 reinforce the connection between the wrap-around portion 125 and the adjustable extension 26. The flat portion of the hinge leaf 21 includes a pair of holes 23 for receiving the screws 123 which are used to fasten the hinge leaf 21 to the frame or cover.

Figure 4:
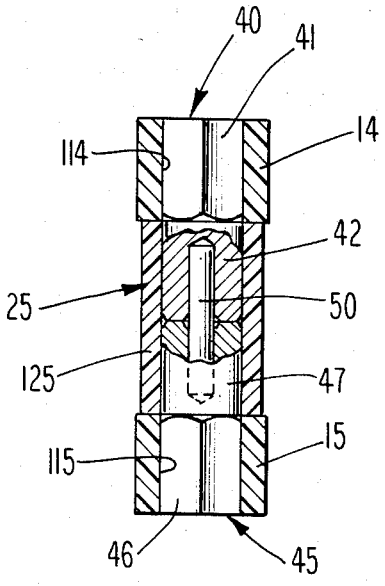
FIG. 4 is a view in section looking along the line 4—4 of FIG. 3.

As illustrated in FIGS. 3 and 4, the hinge pin consists of two identical segments 40 and 45 which are pinned together by a connecting pin 50. This split construction is necessary only if the non-circular portions 41,46 of the hinge pin will not pass through the inside diameter of the clamping knuckle 25. In the illustrated embodiment, the non-circular portions 41,46 have a maximum diameter which is larger than the diameter of the circular portions 42,47 of the hinge pin and also larger than the inside diameter of the wrap-around portion 125 of the knuckle 25. Thus, the non-circular portions 41,46 will not pass through the knuckle 25. However, the maximum diameter of the non-circular portions 41,46 could, if desired, be made equal to or less than the diameter of the circular portion of the hinge pin.

In the illustrated embodiment, the non-circular portions 41,46 of the two pin segments 40,45 are preferrably hexagonal and are necessarily of a size and shape corresponding to that of the hole or bore 114,115 in the non-adjustable knuckles. Each pin segment also has a portion 42,47 of circular cross section which in the illustrated embodiment is of smaller diameter than the non-circular portion. Each of the circular portions 42,47 is provided with a small axial hole into which connecting pin 50 is press fitted.

To install the split hinge pin, the connecting pin 50 is first inserted into the axial hole in the circular portion 42 or 47 of one of the pin segments and then that pin segment is inserted into the hole 114 or 115 in one of the non-adjustable knuckles 14,15 with the circular portion 42 or 47 of the pin segment extending into the inside diameter of the clamping knuckle 25. The other pin segment is then inserted into the hole of the other knuckle 14 or 15, and driven inwardly to force the exposed end of connecting pin 50 into the axial hole of the circular portion of the other pin segment.

Figure 5:
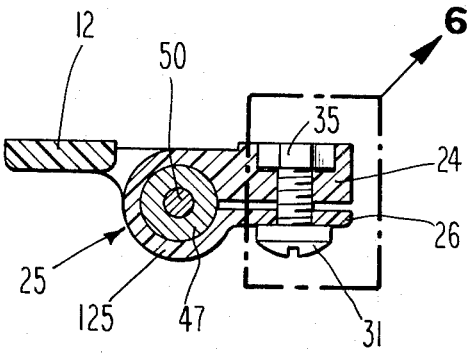
FIG. 5 is a view in section looking along the line 5—5 of FIG. 3.
Figure 7:
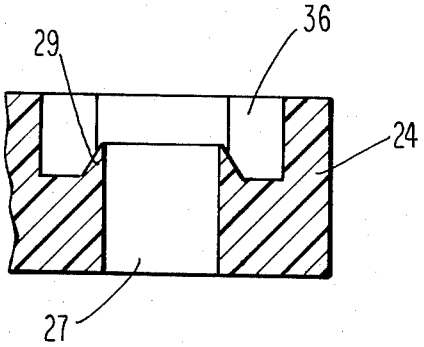
FIG. 7 shows a portion of FIG. 6 before the adjusting screw is tightened.
Figure 6:
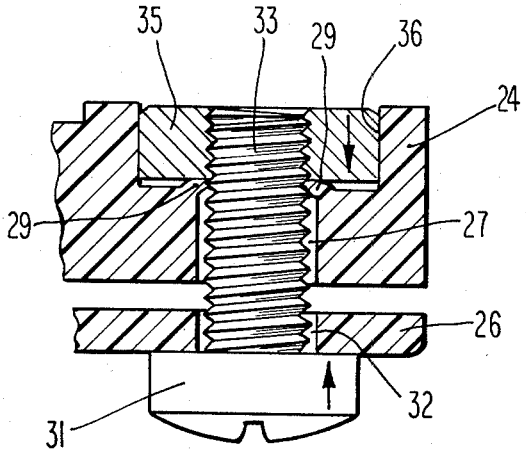
FIG. 6 is a greatly enlarged view of that portion of the hinge assembly which is found within the dashed line rectangle 6 of FIG. 5.

FIG. 5 is a side view showing in cross section the adjustable hinge leaf 21 and the manner in which the clamping knuckle 25 is wrapped around the circular portions 42,47 of the hinge pin and tightened by screw 31. FIG. 6 is an enlarged view of that portion of FIG. 5 shown within the dashed-line rectangle 6. FIG. 7 is an enlarged view of a portion of FIG. 6.

In accordance with the present invention, the inner extension 24 of clamping knuckle 25 is provided with a non-circular recess 36, preferably hexagonal in shape, for receiving a non-circular nut 35 of corresponding shape and size. The fixed inner portion 24 is provided with a circular screw hole 27 which connects with the non-circular recess 36. The adjustable outer portion 26 is similarly provided with a circular screw hole 32, with holes 32 and 27 in registry to receive the threaded shank portion 33 of adjustment screw 31.

As seen in FIG. 7, in accordance with the present invention, the upper edge of hole 27 is characterized by an elevated or raised ring portion 29 which encircles the hole 27. The ring 29 may preferably be triangular in cross section with its outer wall inclining downwardly, outwardly as seen enlarged in FIG. 7. When, as illustrated in FIG. 6, the adjustment screw 31 is tightened, the non-circular, non-rotatable nut 35 is drawn against the raised ring 29 of the portion 24 and, as screw 31 continues to be tightened, the thermoplastic flexible material of ring 29 is squeezed into the threads of the threaded shank 33 of the adjustment screw 31, thereby applying to the screw thread a drag sufficient to prevent loss of adjustment during normal use.

It will be seen from the foregoing description, that the present invention provides a hinge assembly in which the hinge pin is locked against rotation in the spaced apart non-adjustable knuckles of the one hinge leaf and in which the other hinge leaf is connected to the hinge pin by a frictional connection which is adjustable by an adjustment screw which when set will retain its set position during repeated opening and closing of the door or lid or cover.

What is claimed is:

1. An adjustable friction hinge of thermoplastic material, said hinge comprising:

a first hinge leaf having first and second knuckles at spaced separation, each of said first and second knuckles having a non-circular through hole;

a second hinge leaf having a clamping knuckle adapted to be received in the spaced separation between said first and second knuckles of said first hinge leaf, said clamping knuckle having a pair of clamping extensions for adjusting the inside diameter of said clamping knuckle, each of said clamping extensions having a bolt hole therethrough, said bolt holes being in registry with each other, one of said clamping extensions having a non-circular recess therein;

a hinge pin comprising a split pin having first and second identical segments, each segment having a non-circular portion and a circular portion, the non-circular portion having a diameter larger than both the circular portions and the inside diameter of the clamping knuckle, an axial hole in each circular portion, and a connection pin press-fitted into said axial holes and connecting together said first and second segments of said hinge pin, said non-circular portions of said hinge pin being received within said spaced-apart non-circular through holes of said first and second knuckles of said first hinge leaf, said circular portions of said hinge pin being received within the adjustable inside diameter of said clamping knuckle;

an adjustment screw having a threaded shank adapted to pass through said bolt holes of said clamping extensions for adjusting the inside diameter of said clamping knuckle;

a non-circular nut of corresponding shape and size provided in said non-circular recess of said one clamping extension for receiving the threaded shank of said adjustment screw;

said one clamping extension having at the base of said non-circular recess an integral elevated ring encircling its bolt hole and contiguous to the periphery thereof, the material of said ring being adapted, during tightening of said adjustment screw, to be compressed by said nut and squeezed into the threads of said adjustment screw, thereby to impose sufficient drag on said screw to maintain the adjustment.

2. An adjustable friction hinge according to claim 1 wherein said elevated ring is triangular in cross-section.

3. An adjustable friction hinge according to claim 2 wherein the outer wall of said ring inclines downwardly outwardly.

* * * * *